United States Patent [19]

Mortier et al.

[11] 4,303,481

[45] Dec. 1, 1981

[54] ELECTROPLATING DEVICE AND METHOD

[75] Inventors: François Mortier, Jonquieres; Jean-Jacques Sabatier, Senlis, both of France

[73] Assignee: Centre Techniques des Industries Mecaniques, France

[21] Appl. No.: 173,670

[22] Filed: Jul. 29, 1980

[30] Foreign Application Priority Data

Aug. 3, 1979 [FR] France ..... 79 19934

[51] Int. Cl.[3] ..... C25D 7/00; C25D 17/06

[52] U.S. Cl. ..... 204/25; 204/269; 204/272; 204/286

[58] Field of Search ..... 204/25, 272, 260, 286, 204/267, 269, 23

[56] References Cited

U.S. PATENT DOCUMENTS

| | | | |
|---|---|---|---|
| 2,739,937 | 3/1956 | Forestek | 204/272 |
| 3,065,153 | 11/1962 | Hough | 204/272 |
| 3,888,755 | 6/1975 | Wallace | 204/272 |

FOREIGN PATENT DOCUMENTS

| | | | |
|---|---|---|---|
| 2614316 | 10/1976 | Fed. Rep. of Germany | 204/25 |
| 231995 | 11/1968 | U.S.S.R. | 204/272 |

*Primary Examiner*—T. M. Tufariello

*Attorney, Agent, or Firm*—Garrettson Ellis

[57] ABSTRACT

The invention relates to the plating of conductive components by electrolytic deposition.

An electroplating device in accordance with the invention comprises at least one electrolytic cell containing a tubular anode and having inlet and outlet connections for a bath of electrolyte flowing longitudinally through the anode. A removable component-holder of the device comprising means for gripping a component for plating, which component holder is electrically connected to a cathode-supply plate and is adapted to be mounted on the cell to close it and suspend the component along the axis of the anode.

The device can be used inter alia for plating with hard chromium.

8 Claims, 7 Drawing Figures

ELECTROPLATING DEVICE AND METHOD

BACKGROUND OF THE INVENTION

The present invention relates to a method of electroplating and to an electroplating device adapted to produce a flow of an electrolyte past a conductive component to be coated, the electrolyte containing dissolved salts of a metal for electrolytic deposition on the component, which forms the cathode of an electrolytic cell of the device.

Use is already made of devices for treating unit components, where the component to be plated moves relative to the electolyte (e.g. in the case of nickel-plating). In the case of hard chromium plating, however, it is normal to use a stationary bath of electrolyte and there are no known devices for high-speed hard-chromium plating in a moving electrolytic bath and suitable for coating components in mass production on an industrial scale. There is thus a gap in the existing technology which the present invention aims to fill.

SUMMARY OF THE INVENTION

The invention provides an electroplating device comprising: at least one electrolytic cell containing a tubular anode and having inlet and outlet connections for a bath of electrolyte flowing longitudinally through the anode; and a removable component-holder comprising means for gripping a component to be electroplated and electrically co-operating with a cathode-supply plate and mounting and centring means on the cell for closing the cell and suspending the component along the axis of the anode.

Preferably, the electroplating device comprises at least one row of a plurality of cells mounted on common suspending means for suspending the cells immersed in a single common tank of electrolyte. The suspending means may inter alia comprise two half-plates for mounting the anodes in their respective cells and holding therebetween a plate for supplying electricity to the anodes.

According to another preferred feature of the invention, in a device comprising at least one row of cells, the associated component-holders of the row are held together by two half-plates which grip between them the aforementioned cathode-supply plate, which is common to the various component-holders associated with the row of cells.

According to a further preferred feature, the device may comprise an electrolyte-distributing grid secured to the anode in the path of electrolyte flowing through the anode.

The device according to the invention can be used for electrolytic deposition in a flow of electrolyte. It is particularly suitable for plating elongate components with hard chromium. Compared with conventional electroplating devices, it enables the current densities to be very substantially increased without burning the deposit. This increase in current density results in a considerable improvement in the faradic output and a consequent reduction in waste energy consumed during the liberation of hydrogen. The reduction in metal fatigue caused by hydrogen is another result of the improvement in the faradic output. There is also a more uniform thickness of the deposit along the generatrices of the plated elongate components, and a very marked improvement in the resistance to corrosion.

BRIEF DESCRIPTION OF THE DRAWINGS

In order that the invention may be readily understood, an embodiment of an electroplating device according to the invention will now be described, by way of example, with reference to the accompanying drawings, in which.

DESCRIPTION OF PREFERRED EMBODIMENT

In the particular case under consideration, a complete electroplating device embodying the invention comprises three rows each of three electrolytic cells 2. The nine cells 2 are suspended in a common tank 3, where they are partially immersed in an electrolytic bath 4 containing dissolved salts of the metal to be electrodeposited. The actual cells are secured in the tank whereas their covers are removable and also act as component-holders for cathodes constituting the components to be plated.

Figure 2:
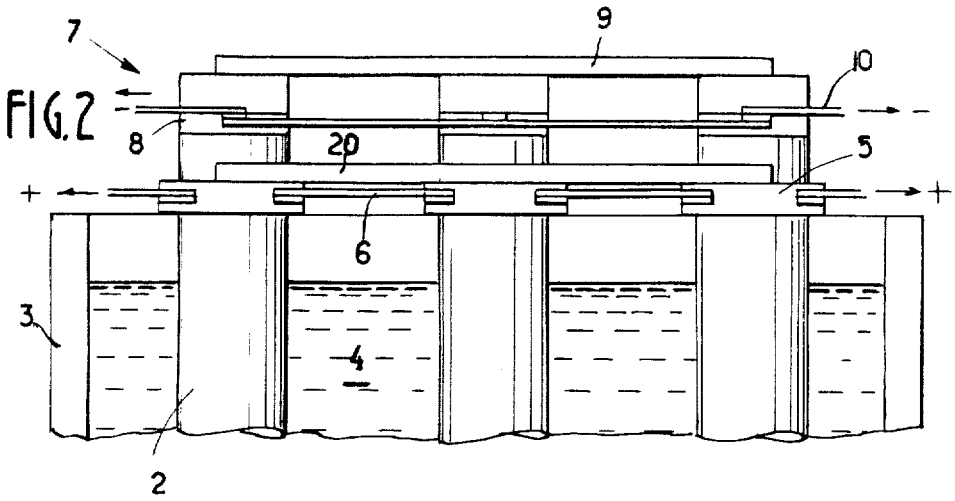
FIG. 2 is a fragmentary view of the device of FIG. 1 in elevation, showing only the top parts of the cells.

As shown in FIG. 2, which illustrates the main features of the assembly the three cells in each row are mounted on a common suspension plate 5 resting on the walls of tank 3. The electrical connections for supplying the anodes are also made to plate 5. The drawing shows, for example, connecting strips 6 for supplying anode current. The strips interconnect the rows of cells, as do connecting bars 20 which give mechanical strength to the assembly.

Above tank 3 the various cells are closed by component-holders 7 (FIG. 2) which are secured in groups of 3 by a support plate 8 to which electric connections are made for supplying the cathode. Once the component-holders have been secured in sealing-tight position on their respective cells, the various support plates 8 are interconnected at the sides of the tank, like plates 5, by strengthening bars 9 and by connecting strips 10 for supplying current.

Figure 3:
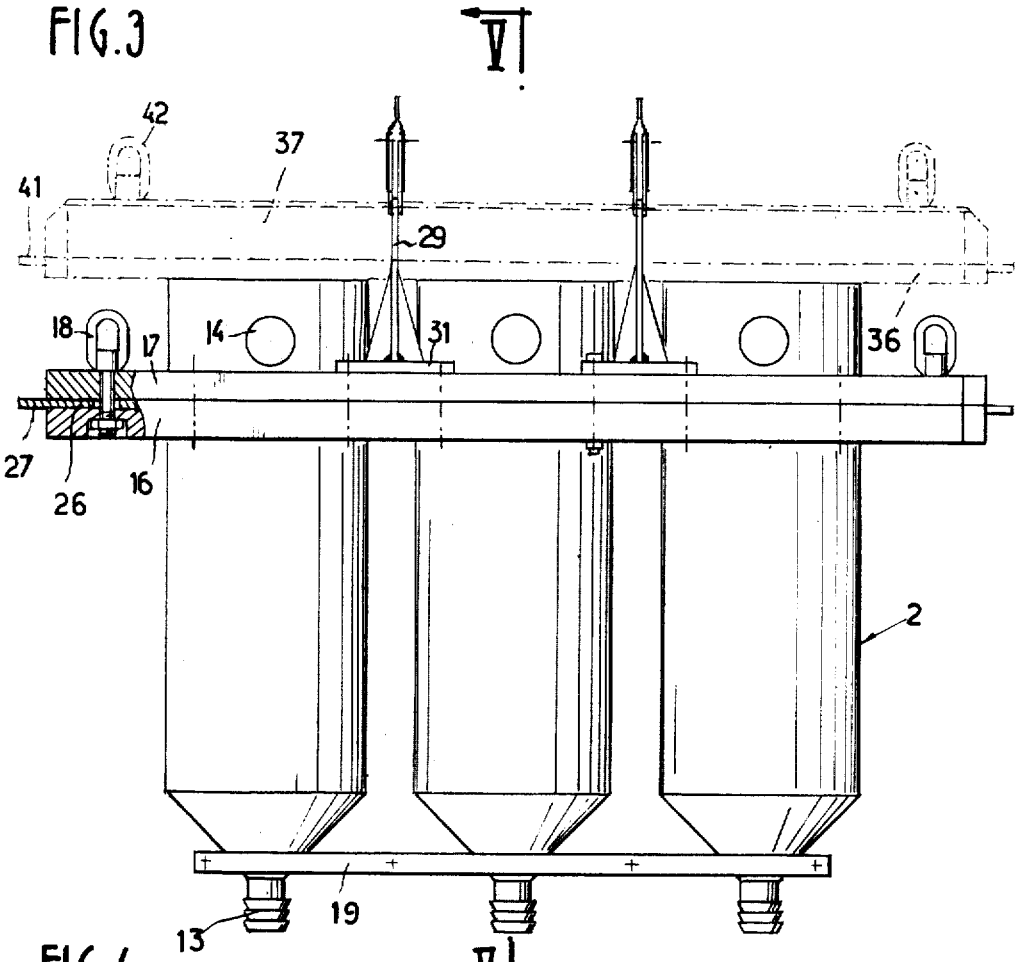
FIG. 3 is a partly cut-away elevational view of a row of three cells, showing the fixed parts of the device; the movable parts, i.e. the cathodes and the associated bearing means, are shown in broken lines.
Figure 4:
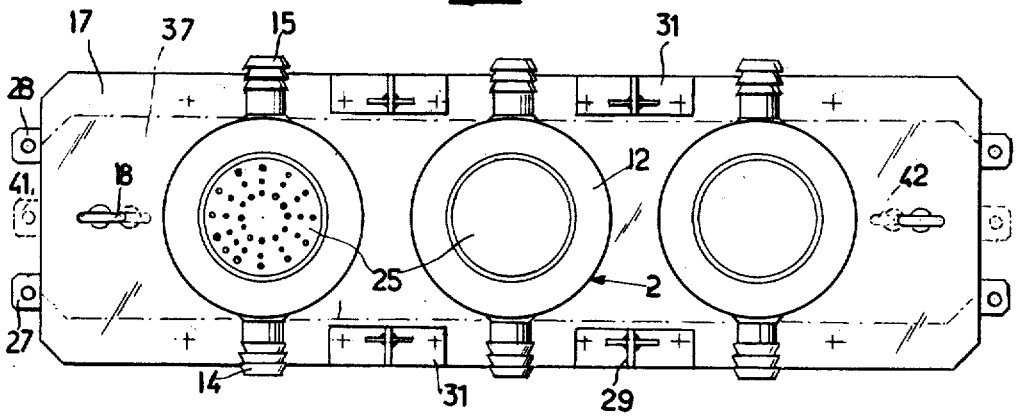
FIG. 4 is a top view of the cells in FIG. 3.
Figure 5:
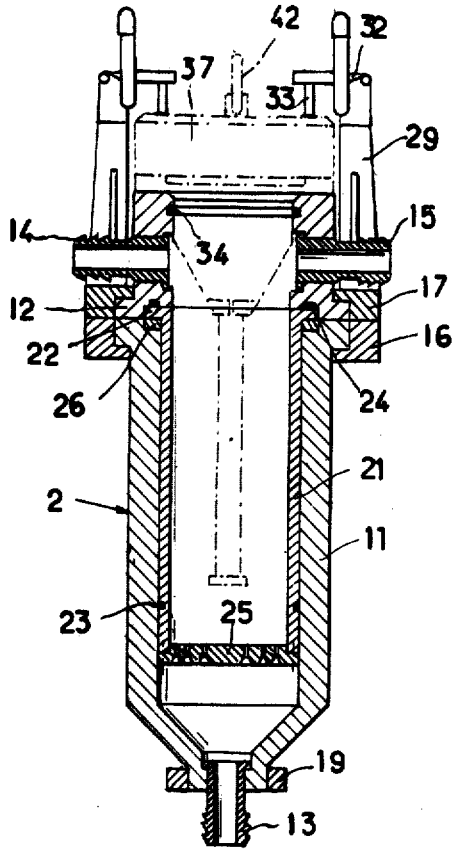
FIG. 5 shows one of the cells in FIG. 3 in longitudinal section in a vertical plane (V—V) perpendicular to the plane of FIG. 3.

The design of the cells is illustrated in greater detail in the illustration of a row of three cells in FIGS. 3 and 4 and in longitudinal section through an individual cell in FIG. 5.

Each cell comprises a cylindrical conical-bottomed vessel 11 which is open at its top, a cylindrical cap 12 being mounted on the end of the vessel. In order to ensure a flow of electrolyte through the cell longitudinally of the vessel, the vessel bottom has an input connection 13 for supplying electrolyte, whereas cap 12 has two diametrically opposite outlet connections 14 and 15.

Figure 1:
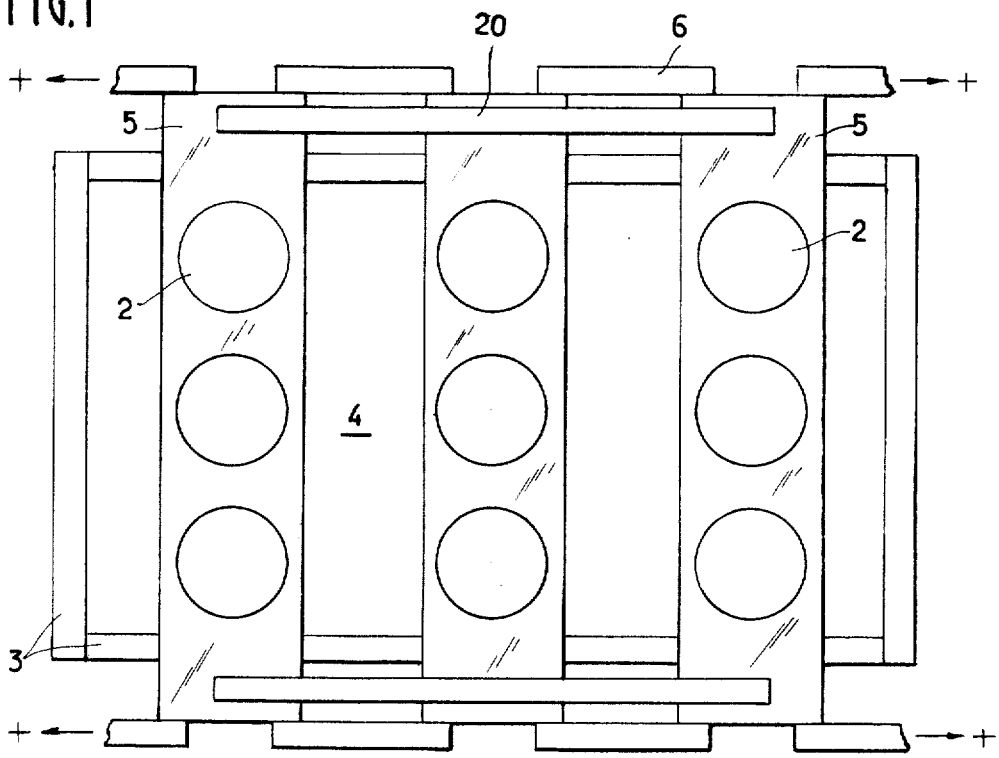
FIG. 1 is a top view of the device, showing the methd of joining a number of rows of cells.

Cap 12 as part of a tubular anode is secured to vessel 11 by two half-plates 16 and 17 bolted together and engaging collars on the vessel and cap respectively. The two half-plates together constitute the suspension plate 5 in FIG. 1 and 2, i.e. the plates 16 and 17 are elongate so as to be common to the three cells in the row, which are thus secured together. At their ends the plates 16 and 17 have eyelets 18 for ease in handling the row. At the bottom, the three cells are likewise interconnected by a cross-member 19 made up of two parts interconnected so as to grip the bottoms of the vessels in specially-provided cavities.

The interior of vessel 11 is lined by a cylindrical anode 21 having a collar 22 at its top end for holding the anode between the vessel 11 and cap 12. An annular seal 23 provides sealing between anode 21 and vessel 11 and an annular seal 24 provides sealing between anode 21 and cap 12. A perforated disc or grid 25 is secured to the bottom end of anode 21 across the flow of electrolyte so as to improve the distribution thereof.

A conductive plate 26 is gripped between collar 22 and the top surface of vessel 11 so as to supply electricity to the anode. In the cross-section of FIG. 5, plate 26 is shown enclosed in the cell walls, but in the longitudinal direction of the row of cells it extends through the walls and is common to the three cells. Beyond the end cells, it is enclosed between the two half-plates 16 and 17, from which electrical terminals 27, 28 project.

The row of cells also bears snap-fastener manipulating devices 29 having supports 31 secured to half-plates 16 and 17. Devices 29 are used for positioning and withdrawing the component-holders. They are equipped with pressure means 32 and jacks 33 pivoted to the snap-fasteners. The mechanisms are adapted to press the component-holders in sealing-tight position on the cells. An annular seal 34 is disposed in cap 12.

Figure 6:
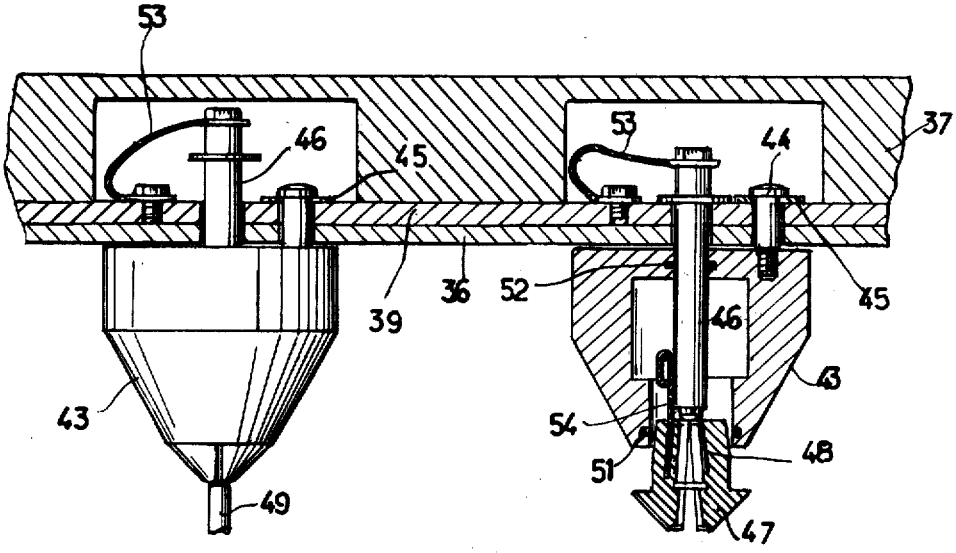
FIG. 6 shows the cathode-bearing assembly, partly in section in a vertical plane.
Figure 7:
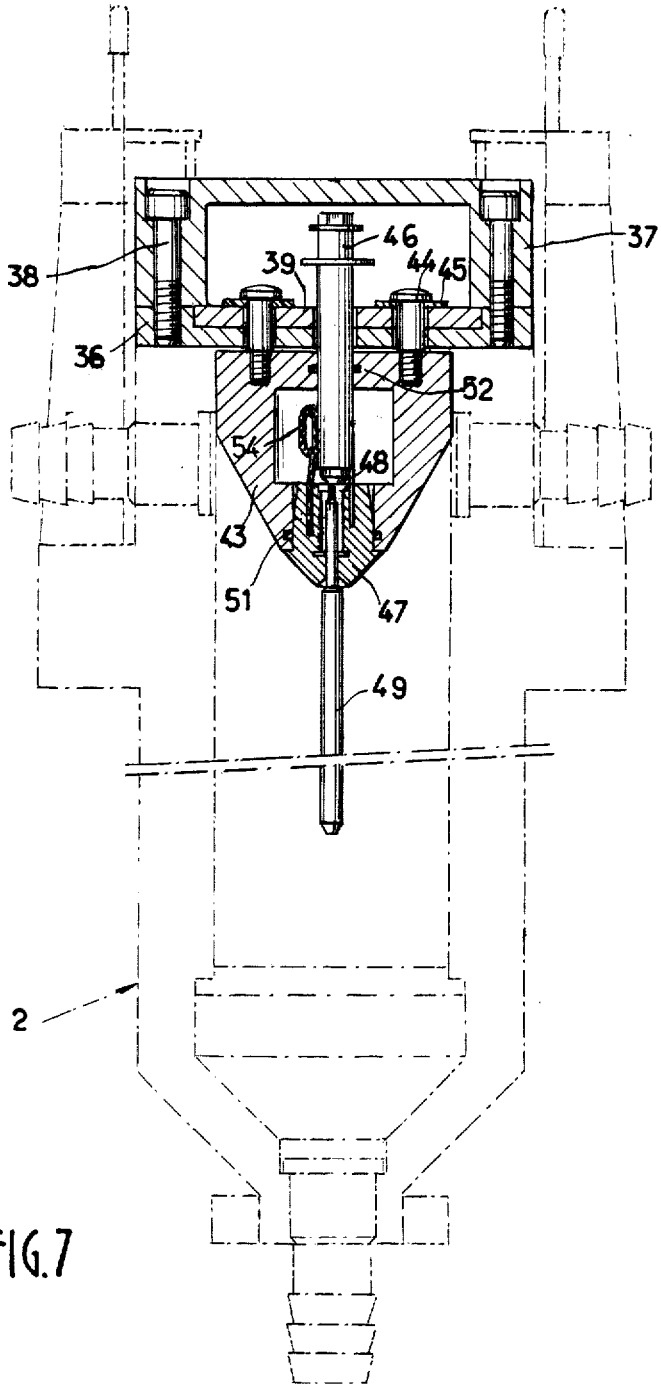
FIG. 7 shows the assembly of FIG. 6 in the position which it occupies over the cells during operation; the cross-sectional plane in FIG. 7 is perpendicular to the plane of FIG. 6 and identical with the plane of FIG. 5.

Referring now to FIGS. 6 and 7, the component-holders are grouped in threes like the corresponding cells. They are secured together by two half-plates 36 and 37 joined together by bolts 38. The half-plates co-operate to enclose a plate 39 in a corresponding recess in the bottom half-plate 36. Plate 39 supplies electricity to the cathodes and has terminals 41 (FIGS. 3–4) projecting from its ends. Eyelets 42 (FIG. 3) are used for manipulating the removable assembly.

The body 43 of each component-holder forms a cone for centring on the top aperture of the corresponding cell. It is secured under the common support means by three screws 44 which extend thrugh half-plate 36 and supply plate 39 and have heads which bear on plate 39 via insulating washers 45.

A shaft 46 slides in it a central hollow of body 43 and carries the three jaws of a gripping means 47 connected thereto by spring strips 48. When body 43 is in the bottom position (FIG. 6) the three jaws come out towards the exterior of body 43 in the grip-open position, whereas when body 43 is in the top position (FIG. 7) the jaws are retracted inside body 43 in the grip-closing position. The gripping means can thus suspend a component for electroplating, e.g. a rod 49 in FIG. 7, from the component-holder. Sealing-tightness in the closed position, for electrolytic treatment, is ensured by a seal 51 between body 43 and means 47 and a seal 52 between body 43 and shaft 46. A cavity is formed above the component-holder in the top half-plate 37 to receive shaft 46 in the open position.

An electrical connection between the component for electroplating and the supply plate 39 is made via shaft 46 and means 47, both made of conductive metal, in co-operation with a braided earth wire 53 having its ends secured in electrical contact with plate 39 and the top of shaft 46, and braided shunt wires 49 having their ends secured to the side of shaft 46 and in each jaw of means 47 respectively.

When the component-holder suspending rod 49 is brought, together with the removable assembly to which it belongs, above the corresponding stationary cell and fitted into it, rod 49 is automatically positioned along the cell axis, i.e. along the axis of the cylindrical anode 21.

During treatment, a flow of electrolyte is maintained by introducing the electrolyte under pressure at the bottom of the vessel and discharging it through an overflow into the tank. A forced flow is maintained by a pump outside the vessel.

By way of example, the aforementioned device can be used on an industrial scale for electroplating hard components such as shock-absorber rods with hard chromium. It can operate under the following conditions, in comparison with treatment in a stationary bath.

| | With flow | | | Stationary bath |
|---|---|---|---|---|
| Bath, g/l $CrO_3$ | 50 | 250 | 250 | 250 |
| g/l $H_2SO_4$ | 0.5 | 2.5 | 2.5 | 2.5 |
| Temperature (°C.) | 70 | 50 | 70 | 50 |
| Current density, A/dm$^2$ | 200 | 200 | 200 | 40 |
| Deposition rate, μm/h | 240 | 360 | 190 | 33 |
| Output (%) | 26 | 40 | 21 | 18 |

It can be seen that, in the case of a given bath, there is an increased in the deposition rate and output compared with conventional conditions. The device, however, can also save material by using baths having a low concentration of chromic acid. Another advantage of the described embodiment is that relatively small-capacity tanks can be used for a given production rate.

Of course, however, the invention is in no way limited to the embodiment described in detail, but includes all variants falling within the spirit of the invention.

We claim:

1. An electrolytic plating device which comprises at least one electrolytic cell comprising: a tubular anode provided with an opening at its upper end for the introduction into it of the component to be electroplated, and provided at its lower part with an electrolyte inlet connection and at its upper part with at least one electrolyte outlet connection; means for causing a flow of electrolyte through said anode via said electrolyte inlet and outlet connections; a removable component-holder formed at its upper part with a cylindrical portion coming in tight adjustment with said tubular anode and formed at its lower part with a conical portion for the automatic centering of said component-holder during its introduction into said opening provided at the upper end of said tubular anode; a flange at the upper end of said component-holder for covering the upper edge of said tublar anode; sealing means between said cylindrical portion of said component-holder and the inner surface of said tubular anode; means for gripping said component to be electroplated provided for at the lower end of said conical portion of said component-holder; and means for electrically connecting said tubular anode and said component to be electroplated to a source of direct current.

2. A device as claimed in claim 1, comprising at least one row of a plurality of said cells, common suspending means for suspending the cells of a said row immersed in a common tank of electrolyte, and a common anode supply plate electrically co-operating with said suspending means for supplying current to the anodes of said row of cells.

3. A device as claimed in claim 2, in which said common suspending means comprise two suspension half-plates detachably connected together and co-operating to hold the anodes in their respective cells, said anode supply plate being held between said suspension half-plates.

4. A device as claimed in claim 2, comprising means for manipulating said component-holders carried by said common suspending means.

5. A device as claimed in claim 4, in which said manipulating means have mechanisms for holding said component-holders in sealing-tight position on the respective cells.

6. A device as claimed in claim 1, comprising at least one row of a plurality of cells, the associated component-holders being secured together by two support half-plates holding therebetween said cathode-supply plate which is common to the various component-holders associated with a said row of cells.

7. A method of using the electroplating device of claim 1 for plating elongate articles with hard chromium, in which method electrolyte is made to flow rapidly through the anode during electrolysis and a high current density is used.

8. A method of chromium-plating in accordance with claim 7, in which the electrolyte contains approximately 50 g/l $CrO_3$ and 0.5 g/l $H_2SO_4$ at about 70° C. and the applied current density is of the order of 200 $A/dm^2$.

* * * * *